US007024832B2

(12) United States Patent
Matumoto et al.

(10) Patent No.: US 7,024,832 B2
(45) Date of Patent: Apr. 11, 2006

(54) THERMAL INSULATION STRUCTURE OF HOUSING AND HEAT SHIELDING MEMBER USED FOR SAME

(75) Inventors: Setuya Matumoto, Sapporo (JP); Takashi Satou, Sapporo (JP); Sadahiro Inoue, Sapporo (JP); Yuumi Akitaya, Sapporo (JP)

(73) Assignee: Matumotokenkou Kabushiki Kaisha, Hokkaidou (JP)

( * ) Notice: Subject to any disclaimer, the term of this patent is extended or adjusted under 35 U.S.C. 154(b) by 96 days.

(21) Appl. No.: 10/169,892

(22) PCT Filed: Sep. 6, 2001

(86) PCT No.: PCT/JP01/07720

§ 371 (c)(1),
(2), (4) Date: Jul. 8, 2002

(87) PCT Pub. No.: WO02/20912

PCT Pub. Date: Mar. 14, 2002

(65) Prior Publication Data

US 2003/0009965 A1 Jan. 16, 2003

(30) Foreign Application Priority Data

Sep. 7, 2000 (JP) ..... 2000-271335

(51) Int. Cl.
*E04B 1/74* (2006.01)

(52) U.S. Cl. ..... 52/407.3; 52/407.2; 52/407.5; 52/309.17; 52/793.1; 52/787.11; 52/783.1; 52/302.3; 52/309.9; 428/228; 428/138; 428/251; 428/268

(58) Field of Classification Search ..... 52/407.1, 52/407.3, 407.5, 309.17, 793.1, 787.11, 794.1, 52/783.1, 302.3, 302.5, 309.9, 407.2; 428/228, 428/138, 251, 268

See application file for complete search history.

(56) References Cited

U.S. PATENT DOCUMENTS

| | | | | | |
|---|---|---|---|---|---|
| 2,239,394 | A | * | 4/1941 | MacKechnie | 52/407.3 |
| 3,698,145 | A | * | 10/1972 | Newman et al. | 52/144 |
| 3,783,563 | A | * | 1/1974 | Moore | 52/11 |
| 3,789,094 | A | * | 1/1974 | Hutchison | 264/46.5 |
| 3,835,604 | A | * | 9/1974 | Hoffman, Jr. | 52/105 |
| 3,842,559 | A | * | 10/1974 | Payne | 52/309.12 |
| 3,990,202 | A | | 11/1976 | Becker | |
| 4,019,938 | A | * | 4/1977 | Forrester | 156/78 |
| 4,084,366 | A | * | 4/1978 | Saylor et al. | 52/791.1 |

(Continued)

FOREIGN PATENT DOCUMENTS

| | | |
|---|---|---|
| JP | 63-5936 | 1/1988 |
| JP | 09-184213 | 7/1997 |

OTHER PUBLICATIONS

Search Report dated March 15, 2004 in European Application No. 01963457.5–2303–JP0107720.

*Primary Examiner*—Carl D. Friedman
*Assistant Examiner*—Christy Green
(74) *Attorney, Agent, or Firm*—Flynn, Thiel, Boutell & Tanis

(57) ABSTRACT

The invention is intended to reduce heat accumulation in the heat insulator provided around the periphery of the living room of a house structure, thereby achieving simplification of a construction work, energy-saving, and rationalization in maintaining the living environment, and by covering the external face of the heat insulators (2) disposed around the periphery of partition sheet members surrounding the living room, such as the roof, ceiling, wall, and so forth, with the heat shielding members (1) provided with the heat reflection foil, so that radiant heat which will otherwise heat up the heat insulators (2) can be blocked, and heat accumulation in the heat insulators (2) can be reduced.

11 Claims, 8 Drawing Sheets

U.S. PATENT DOCUMENTS 4,254,188 A * 3/1981 Campbell et al. ..... 428/594
4,302,503 A * 11/1981 Mattimoe ..... 428/323
4,326,909 A * 4/1982 Slavik ..... 156/253
4,446,661 A * 5/1984 Jonsson et al. ..... 52/95
4,671,035 A * 6/1987 Ridge ..... 52/393
4,707,393 A * 11/1987 Vetter ..... 428/178
4,726,985 A * 2/1988 Fay et al. ..... 428/138
4,819,405 A * 4/1989 Jackson ..... 52/795.1
4,825,089 A * 4/1989 Lindsay ..... 250/515.1
5,106,668 A * 4/1992 Turner et al. ..... 428/116
5,309,690 A * 5/1994 Symons ..... 52/309.9
5,359,883 A * 11/1994 Baldwin et al. ..... 73/117.3
5,561,958 A * 10/1996 Clement et al. ..... 52/407.1
5,561,959 A * 10/1996 Alderman et al. ..... 52/407.3
5,626,936 A * 5/1997 Alderman ..... 428/68
5,770,295 A * 6/1998 Alderman ..... 428/68
5,804,278 A * 9/1998 Pike ..... 428/116
5,806,264 A * 9/1998 Boot ..... 52/415
5,826,390 A * 10/1998 Sacks ..... 52/408
5,855,154 A * 1/1999 Schakel et al. ..... 83/23
5,888,613 A * 3/1999 Ketcham et al. ..... 428/116
5,914,175 A * 6/1999 Nudo et al. ..... 428/178
5,992,112 A * 11/1999 Josey ..... 52/309.8
6,067,764 A * 5/2000 Johansen ..... 52/302.1
6,080,495 A * 6/2000 Wright ..... 428/623
6,108,998 A * 8/2000 Dumlao ..... 52/783.17
6,174,587 B1 * 1/2001 Figge, Sr. ..... 428/178
6,256,959 B1 * 7/2001 Palmersten ..... 52/588.1
6,279,284 B1 * 8/2001 Moras ..... 52/408
6,537,413 B1 * 3/2003 Hochet et al. ..... 156/297
6,557,313 B1 * 5/2003 Alderman ..... 52/407.3
6,645,598 B1 * 11/2003 Alderman ..... 428/69

* cited by examiner

THERMAL INSULATION STRUCTURE OF HOUSING AND HEAT SHIELDING MEMBER USED FOR SAME

TECHNICAL FIELD

The invention is intended to provide improvement on a thermal insulation structure of a house, and is related to the technical field of housing construction.

BACKGROUND TECHNOLOGY

A common wooden building is constructed such that temperature inside an attic thereof is rendered similar to the temperature of outside air as much as possible by providing an attic ventilating opening in a region such as the transverse wall thereof, and so forth, however, the temperature inside the attic rises at times to a high level (70° C. or higher) depending on a building district where the building is built, insolation condition, and a season involved.

In order to mitigate such adverse effect of heating in the space of the attic on a sitting room, it is a common practice to install a fibrous heat insulator for blowing or a rigid urethane foam heat insulator on the rear face of the ceiling of the sitting room.

In FIG. 8, a rigid urethane foam heat insulator 2 installed on the upper face of the ceiling of a conventional sitting room is shown, and the rigid urethane foam heat insulator 2 having a thickness of 200 mm is laid on the ceiling 3 while a ventilating opening $O_2$ is provided in the upper part of the outside wall W.

Accordingly, heat transfer in the interior $R_o$ of the attic takes place such that intruding heat $T_1$ propagating through the surface of the roof 4 and gaps $O_1$ heats up the rigid urethane foam heat insulator 2 to be accumulated therein while warms up the interior Ro of the attic, part of the intruding heat propagates into the sitting room R as transmission heat $T_3$, and hot air having heated up the rigid urethane foam heat insulator 2 is emitted through the ventilating opening $O_2$ as emission heat $T_2$, thereby forming a circulatory flow of the intruding heat $T_1$.

Even a heat insulator having high heat insulating performance such as a rigid urethane foam heat insulator 2 and a fibrous heat insulating member 2 for blowing will reach a high temperature after absorbing heat, and, if subjected to heating by solar heat for long hours, whereupon the transmission heat $T_3$ at a high temperature is conducted by transmission to a sitting room R, thereby interfering with maintenance of a comfortable environment in the sitting room R, that is, maintenance of an adequate room temperature. In addition, even if the temperature of the outside air $T_1$ falls, the heat insulator 2 acting as a heat accumulator cools down slowly owing to its heat capacity, so that the heat insulator 2 acting to insulate heat at a high temperature in the interior $R_o$ of the attic during the day emits heat acting as the heat accumulator at night, thereby causing a problem that air conditioning equipment in the room R, such as a cooler, will be subjected to an untoward load.

The invention has been developed to overcome the problem described above, and it is an object of the invention to mitigate heat accumulation in the heat insulator 2 by protecting the heat insulator 2 with a heat shielding member 1 so as not to allow heat of air at temperature during the day to directly heat the heat insulator 2 to be accumulated therein, and by blocking and reducing a heating load applied to the heat insulator 2 by the agency of the heat shielding member 1. Accordingly, the invention is quite effective when applied to a heat insulator installed on the rear surfaces of the roof and the ceiling, respectively, subjected to a strong effect of radiant heat (heat rays), and a heat insulator installed on the rear surfaces of the outside wall, the floor, and so forth, under the influence of radiant heat.

DISCLOSURE OF THE INVENTION

To that end, as shown in FIG. 1 by way of example, a thermal insulation structure according to the invention comprises a heat insulator 2 in a board form, disposed at suitable spots on the inner face of a roof 4 of the house, and on the outside face of partition sheet members of the house, such as a ceiling 3, walls, and so forth, surrounding a living room R, respectively, and a heat shielding member 1 disposed on the outside face of the respective heat insulators 2 in the board form, made up of a plurality of sheets 11, 12, 13 of which at least the upper sheet 11 is provided with a heat reflection foil M on the upper face thereof, wherein respective spaces S of an air layer are formed between the respective sheets with a group of stand-up pieces 14, 15, thereby mitigating heat accumulation in the respective heat insulators 2 by the effect of the respective heat shielding members 1.

Accordingly, for example, in the interior $R_o$ of an attic, radiant heat (heat rays) of an attic interior heat $T_o$ rising to a high temperature as a result of accumulation of intruding heat $T_1$ making ingress into the interior $R_o$ of the attic through the surface of the roof 4 and gaps $O_1$ of the roof 4 undergo specular reflection because the heat reflection foil M of the upper sheet 11 of the respective heat shielding members 1 has a microscopically smooth surface, thereby blocking downward conduction of heat from the respective heat shielding members 1 by the heat rays, and further, since the air layer in the respective spaces S fulfills a thermal insulation function, and no conduction heat is generated in the heat reflection foil M having a thin layer, the calorie of load heat from the respective heat shielding members 1 can be mitigated in relation to the respective heat insulators 2 disposed underneath the former, so that heating of the respective heat insulators 2 and heat accumulation therein can be mitigated, thereby reducing an amount of heat from the respective heat insulators 2 penetrating into the living room R through the ceiling 3.

As a result, it is possible to reduce during the day and at night the amount of heat penetrating into the living room R from the respective heat insulators 2 where heat accumulation is mitigated by the agency of the respective heat shielding members 1, thus exhibiting the effect of eventually reducing energy required for cooling the living room R.

Also, since the heat reflection foil M is thin but has no minuscule through-holes, the same is able to fulfill a protection function for respective substrate sheets, thereby restraining deterioration of the respective heat shielding members 1 over time.

Still also, since the heat insulator 2 is in a board form, it is easy to dispose and install the heat shielding member 1.

Moreover, since the heat shielding member 1 is made up of the plurality of the sheets with the group of the stand-up pieces 14 and the stand-up pieces 15, which can be laid down, interposed therebetween, the same can be turned into a stacked form of a reduced bulk by laying down the stand-up pieces 14, and the stand-up pieces 15, at the time of storage and transportation thereof, thus enabling the heat shielding member 1 to be handled with ease.

Meanwhile, in the present description, "the heat reflection foil" refers to a thin metal foil such as an aluminum foil, tin foil, capable of reflecting heat rays (infrared radiation) and generating no conduction heat, and the thinner it is, the better from the functional and economic points of view. Typically, it is an aluminum foil having a thickness in a range of $6\times10^{-3}$ to $6\times10^{-2}$ mm, which is a product available in the market. According to the JIS standard, the thickness of an aluminum foil is in a range of $6\times10^{-3}$ to $2\times10^{-1}$ mm, however, if it becomes thicker, this is improper in respect of rigidity and conduction heat. Accordingly, even from the functional and economic points of view, a thin foil having a thickness in a range of $6\times10^{-3}$ to $6\times10^{-2}$ mm, having no minuscule through-holes, is advantageous.

Also, "a member in a board form", having shape-retention property, such as a foamed synthetic resin, wooden heat insulator, and so forth, may be used for the board heat insulator, and a "sheet" such as paper, nonwoven fabric, plastic film, and so forth, having shape-retention property, to which a foil can be bonded, may be used for the sheets making up the heat shielding member, however, at a location where permeation of vapor from inside of a room is anticipated, minuscule through-holes are preferably provided in the sheets, particularly, in the sheet of the lower layer, or material having a function of absorbing and releasing moisture is preferably selected so as to prevent dew condensation between the heat insulator 2 and the heat shielding member 1.

Meanwhile, in this connection, it is to be pointed out that there is a possibility that the aluminum foil as a typical example of the heat reflection foil M is assumed to be a constituent member having a function equivalent to that (to be an equivalent) of a vapor deposited aluminum film, however, an aluminum-bonded foil using kraft paper as a substrate is completely different as a heat reflection thin layer from a vacuum deposited aluminum film using a kraft paper as a substrate, which will be described hereinafter. Accordingly, with the present invention, the heat reflection foil is not equivalent to the vapor deposited aluminum film.

(Production Aspect of the Invention)

The aluminum-bonded foil is obtained simply by bonding an aluminum foil to kraft paper with an inexpensive (about 4 million yen) adhesion apparatus made up of a roll coater and a roll press, and even if kraft paper contains moisture to the extent that it is in as air-dry state, bonding can be implemented without any hitch, thereby enabling production to be performed easily, and efficiently at a low cost.

On the other hand, the vacuum deposited aluminum film is obtained by drying a kraft paper substrate in a vacuum heating and drying equipment, and by executing vacuum deposition of aluminum in a sputtering system, so that production facilities become expensive (about 50 million yen), resulting in a high production cost.

(Installation Aspect of the Invention)

Since the aluminum-bonded foil has a thickness in a range of $6\times10^{-3}$ (0.006) to $6\times10^{-2}$ (0.06) mm, it sustains hardly any even if slightly bent during the installation thereof. Accordingly, the aluminum-bonded foil can withstand rough handling, and is easy to install.

On the other hand, the vacuum deposited aluminum film has a thickness in the order of $5\times10^{-5}$ mm, as thin as less than 1/120 of the thickness of the aluminum-bonded foil, so that the layer of the vacuum deposited aluminum film sustains damage if bent during the installation thereof. Accordingly, close attention is required in the handling and installation thereof.

(Function Aspect of the Invention)

The aluminum-bonded foil has a surface which is smooth at the molecular level thereof, and consequently, has uniform and excellent heat shielding performance because infrared radiation (heat rays) undergo specular reflection at the surface thereof. Further, since there exists no minuscule through-hole in the surface of the aluminum-bonded foil, a substrate protection action thereof is perfect, and an adverse effect (deterioration of the substrate due to permeation of moisture) caused by ingress of dew condensation water into kraft paper will not result, so that the aluminum-bonded foil has a long service life, and is able to exhibit a heat shielding performance during the service life of a house.

On the other hand, since the vacuum deposited aluminum film is a deposition film formed on basis of a molecular unit, the same has minuscule asperities on the surface thereof in the microscopic sense, and there exists a multitude of minuscule through-holes in the surface, so that a substrate protection action thereof is inferior. Accordingly, the vacuum deposited aluminum film has a heat shielding performance inferior to that of the aluminum-bonded foil because infrared radiation (heat rays) undergo diffuse reflection at the surface of the vacuum deposited aluminum film. Moreover, because the thickness of the vacuum deposited aluminum film is thin, time-dependent deterioration in quality thereof takes place early, and further, ingress of dew condensation water (water molecules) is allowed through the minuscule through-holes, so that deterioration of kraft paper (the substrate) also occurs over time, thereby rendering durability of the heat shielding member quite short.

As described in the foregoing, it is evident that in all of the production, installation and functional aspects, the aluminum-bonded foil, that is, the heat reflection foil as a member of the heat shielding member, having a heat reflection function, is superior by far to the vacuum deposited aluminum film. Accordingly, in the constitution of the invention, what is specified as "the heat reflection foil" as a result of various tests is technically different from "the heat reflection film" such as the vacuum deposited aluminum film, and the like, and it is evident that technical significance lies in this respect.

Also, with the heat shielding member 1 made up of the plurality of the sheets 11, 12, 13, since at least the upper sheet 11, and the sheets 13 of the next layer are provided with the heat reflection foil M on the upper face thereof, respectively, even if there occurs deterioration in the heat reflection performance of the heat reflection foil M of the upper sheet 11, relatively susceptible to contaminaton, due to adhesion of dust thereto, and parts of heat rays are thereby allowed to be transmitted downward, deterioration in the reflection performance of the heat shielding member 1 as a whole, with respect to radiant heat (heat rays), can be prevented by the heat reflection performance of the heat reflection foil (an aluminum foil) of the sheets 13 of the next layer, thereby enabling a function of the heat shielding member 1 for blocking heat rays to be maintained. In addition, since the heat reflection foil has a flat surface without minuscule asperities thereon, the same can block heat rays by specular reflection, so that the heat shielding performance thereof is excellent.

Also, since the heat shielding member 1 wherein the respective spaces S of the air layer have the openings so as to enable ventilation to be effected in the longitudinal direction thereof are installed such that the openings at opposite ends of the respective spaces S are not close, there occur slight airflows $A_1$, $A_2$, passing through the heat shielding member 1, thereby preventing dew condensation while mitigating heat conduction to the heat insulator 2 by ventilation effected in the respective spaces S. Moreover, the respective sheets of the heat shielding member 1 can be rendered into a compact stacked form before the installation, which provides an advantage in storing, transporting and handling the same.

The heat insulators 2 is preferably a wooden heat insulator such as an insulation board, and so forth, and the respective sheets 11, 12, 13, making up the heat shielding member 1, are preferably made of paper.

The insulation board is obtained by disentangling wooden material, such as scrap lumber, wood chips, lumbers from thinning, and so forth, into pieces several tens of mm in diameter, and several mm in length before forming the same by the paper making method. Accordingly, the insulation board has an excellent function for temperature adjustment by absorbing and discharging moisture, and dew concentration does not occur to the surface thereof, so that deterioration with time in the heat insulation function thereof is small. Further, since the respective sheets of the heat shielding member 1 is made of paper, not only the heat shielding member 1 naturally gains an advantage in that dew condensation does not occur to a face thereof, in contact with the wooden heat insulator 2, by virtue of a function of the paper for absorbing and discharging moisture, but also it is easy to stick a metal foil to a paper sheet, thus enabling the heat shielding member 1 to be fabricated at a low cost. Moreover, it is to be pointed out that since the wooden heat insulator and paper undergo natural decomposition by the agency of microorganisms after disposed, these will impose only a small burden on the environment as a result of disposal thereof following the dismantlement of a house, and accordingly, adoption of the wooden heat insulator 2 is quite effective from the functional and environmental points of view.

Also, the heat shielding member 2. fixedly attached beforehand to the heat insulator can be installed with relative ease at locations, for example, the rear face of the roof, the underside of the floor, and the like, where it is difficult to install the heat shielding member 1 alone, owing to the shape-retention property of the heat insulator 2 in a board form.

As shown in FIG. 2 by way of example, the heat shielding member 1 according to the invention includes at least an upper sheet 11, and a lower sheet 12, and a heat reflection foil M laminated to the upper face of at least the upper sheet 11, and respective spaces S of an air layer formed between the respective sheets with a group of stand-up pieces 14, 15, thereby forming a structure wherein the respective sheets can be pressed in contact with each other, and stacked by laying down the group of the stand-up pieces 14, 15.

Accordingly, the heat shielding member of high performance, wherein the heat reflection foil M blocks transmission of heat rays by causing the same to undergo specular reflection, and prevention of dew condensation and mitigation of heat conduction are effected by the agency of the respective spaces S of the air layers, can be handled as a stacked sheet structure in a reduced bulk state at the time of fabrication, storage, and transportation. The installation of the heat shielding member 1 can be completed simply by pulling one end of the upper sheet 11 and the lower sheet 12, respectively, in the respective directions of the arrow F, opposite to each other, as shown in FIG. 2(B), to thereby raise the stand-up pieces 14, and the stand-up pieces 15, and by securing both the ends of the lower sheet 12 and the upper sheet 11, respectively, to surrounding members, so that the installation is feasible as long as there is available a space on the heat insulator 2 for placing the heat shielding member 1 thereon, thus facilitating the handling and installation of the heat shielding member 1. Moreover, since the heat reflection foil M such as an aluminum foil is a product in a sheet form, easily obtainable in the market, the same can be efficiently laminated to the upper sheet 11 with a common type roll adhesion apparatus.

Also, since the upper faces of the upper sheet 11 and the sheets 13 of the next layer are provided with the heat reflection foil M, respectively, deterioration in the reflection performance of the heat reflection foil M on the upper sheet 11 due to contamination thereof after the installation is naturally compensated for by presence of the heat reflection foil M on the sheets 13 of the next layer, and further, even if the heat reflection foil M on the upper sheet 11 gets contaminated in the course of storage and handling, there is hardly any risk of the heat reflection foil M on the sheets 13 of the next layer because of protection provided by the upper sheet 11. Thus, it can be said that the heat shielding member 1 is a heat shielding member having excellent durability without the need for worrying about deterioration in radiant heat reflection performance thereof.

In order for the stand-up pieces 14 and the stand-up pieces 15 to be securely attached to the upper sheet 11 and the lower sheet 12, respectively, at the bent-up face 14' and the bent-up face 15', provided at the opposite ends of the stand-up pieces 14, 15, respectively, and to be freely bendable at the respective bent-up parts r, the respective constituent sheet members of the heat shielding member 1, that is, the sheets 11, 12, 13, and the stand-up pieces 14, 15 are all horizontally disposed with necessary parts of the respective bent-up faces 14' and 15', kept in as-folded state, as shown in FIG. 2(A), and the respective constituent sheet members are press-bonded after applying an adhesive to the bent-up faces 14' and 15' of the stand-up pieces 14, 15 respectively, thereby enabling the heat shielding member 1 to be formed. The formation of the heat shielding member 1 with the respective constituent sheet members after lamination of the heat reflection foil M, obtainable in the sheet form, onto the sheets 11, 13, respectively, with the roll adhesion apparatus can be implemented by a flow process comprising the steps of "putting creases→folding→providing an adhesive→press-bonding→cutting to given sizes" while feeding all the constituent sheet members in a sheet state into an apparatus made up of a roller group. Thus, it is possible to implement simple and rational fabrication of the heat shielding member 1 from the lamination of the heat reflection foil to the respective sheets up to completion thereof by assembling the sheets.

With the heat shielding member 1 wherein the intermediate sheets 13 are securely attached to the stand-up pieces 14, 15, respectively, with the bent-up face 13' at the opposite ends thereof in such a way as to be freely bendable at respective bent-up parts r, the space S of the air layer is formed at both an upper layer and a lower layer with the intermediate sheets 13, thereby increasing mitigation of heat conduction due to the effect of the respective spaces S. It is evident from FIG. 2(A) showing a layout for fabrication that, in fabricating the heat shielding member 1, rational and mechanized fabrication can be carried out by use of the apparatus made up of the roller group.

Also, with the heat shielding member 1 wherein the face of the lower sheet 12 is fixedly attached to the upper face of the board heat insulator 2, the heat shielding member 1 formed integrally with the heat insulator 2 can be installed with relative ease at locations, for example, the rear face of the roof, the underside of the floor, and the like, where it is difficult to install the heat shielding member 1 alone, because the heat insulator 2 is a board member having the shape-retention property.

Accordingly, there is no fear of the heat insulator 2, even if installed on inclined surfaces, sliding down or losing thickness thereof over time as with the case of the fibrous heat insulator for blowing, so that the heat insulator 2 wherein heat accumulation is mitigated by the effect of the heat shielding member 1 can be freely fitted into required spots.

Also, with the heat shielding member wherein the underside face of the lower sheet 12 is fixedly attached to the heat insulator 2 by a bonding strength after solidification bonding due to foam molding of the rigid urethane foam heat insulator 2, molding of the heat insulator 2 is executed by setting up a mold with the constituent sheet members of the heat shielding member 1, kept in a state as pressed into contact with each other and stacked as shown in FIG. 4, so that bonding and fixing of the heat shielding member 1 onto the heat insulator 2 can be implemented concurrently with the formation of the board heat insulator 2. Thus, the fabrication of the heat shielding member with the heat insulator having shape-retention property, attached thereto, can be carried out easily and rationally.

Also, with the heat shielding member provided with the heat insulator using the wooden board heat insulator 2 as the board heat insulator 2, an installation work can be rendered easier due to the shape-retention property of the wooden board heat insulator 2, and since the wooden board heat insulator 2 itself has both sound insulating property and property for absorbing and discharging moisture, it is possible to mitigate heat accumulation in the heat insulator in the thermal insulation structure of a house to which the invention is applied. Moreover, it becomes possible to provide an excellent housing environment, high in sound insulating performance, and causing no dew condensation, and in particular, if the heat shielding member according to the invention is applied to the inner face of the roof, the sound of rain can be shut out. In addition, because the wooden heat insulator will undergo natural decomposition by the agency of microorganisms, and return to the earth relatively soon after disposed following the dismantlement of a house, it does not impose a burden on the environment.

Meanwhile, in the present description, the wooden heat insulator broadly refers to the wooden heat insulator in a board form, obtained by rendering wooden material, such as scrap lumber, wood chips, lumbers from thinning, and so forth, into chips, and making paper out of woodpulp obtained by disentangling wooden fibers, before drying, which exhibit a function equivalent to that of an insulation board of a density at less than 0.35 g/cm$^3$ conforming to JIS A5905 and a off-grade thereof, having an excellent moisture adjustment performance for absorbing and discharging moisture, and sound insulating property as well as heat insulating property.

BRIEF DESCRIPTION OF THE DRAWINGS

FIGS. 2(A), 2(B) and 2(C) are sectional views illustrating the structure of a heat shielding member according to the invention, wherein FIG. 2(A) shows the relative disposition of respective constituent members during a fabrication process, FIG. 2(B) shows a process of transformation from a stacked structure after fabrication to a three-dimensional structure, and FIG. 2(C) shows a structure at the time of application;

FIGS. 3(A), 3(B) and 3(C) are schematic illustrations showing application of the heat shielding member according to the invention to the rear face of the ceiling, wherein FIG. 3(A) is a perspective view as a whole, FIG. 3(B) shows an enlarged detail of part B in FIG. 3(A), and FIG. 3(C) is an enlarged detail of part C in FIG. 3(A);

FIGS. 4(A) and 4(B) are schematic illustrations showing fabrication of the heat shielding member according to the invention, wherein FIG. 4(A) is a plan view of a mold set for molding a heat insulator, and FIG. 4(B) is an elevational view of the same;

FIGS. 6(A) and 6(B) are perspective views of the heat shielding member with the heat insulator attached thereto, provided with splints, according to the invention, wherein FIG. 6(A) shows a rift provided in a portion of the heat shielding member, and FIG. 6(B) shows the portion of the heat shielding member as flattened;

DETAILED DESCRIPTION

Fabrication of Heat Shielding Member

A roll of aluminum foil easily obtainable in the market, having a thickness in a range of $6\times10^{-3}$ to $6\times10^{-2}$ mm, for use as a heat reflection foil, is prepared, and kraft paper and the aluminum foil are bonded together with a common type adhesion apparatus (not shown) made up of a roll coater and a roll press, thereby forming a sheet member with the aluminum foil laminated to the surface thereof.

Figure 2A:
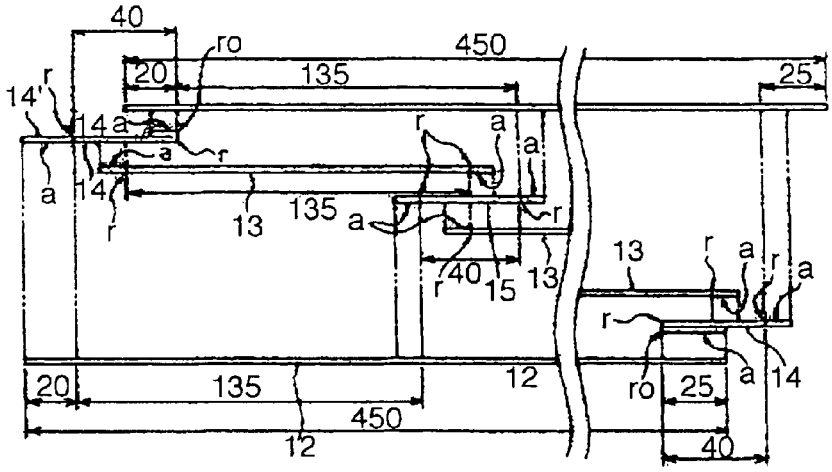

FIG. 2(A) shows relationship in position of respective constituent sheet members, long in length, making up a heat shielding member, immediately before applying a process of press-contacting and bonding thereto, and the constituent sheet members include an upper sheet 11, intermediate sheets 13, a lower sheet 12, and a stand-up piece 14 provided on the opposite ends of the heat shielding member, made of paper coated with the aluminum foil bonded to the surface thereof, respectively, together with intermediate stand-up pieces 15, made of paper not coated with the aluminum foil. The thickness of the upper sheet 11 and the stand-up piece 14 provided on the opposite ends of the heat shielding member, respectively, is 0.3 mm, and the thickness of other sheet members, respectively, is 0.1 mm while the width of the upper sheet 11 and the lower sheet 12, respectively, is in a range of 400 to 500 mm, the width of the respective intermediate sheets 13 is in a range of 100 to 200 mm plus 10 mm for a bent-up face 13' at the opposite ends thereof, the width of the respective intermediate stand-up pieces 15 is in a range of 30 to 50 mm plus 10 mm for a bent-up face 15' at the opposite ends thereof, and the width of the stand-up piece 14 on the opposite ends of the heat shielding member, respectively, is in a range of 30 to 50 mm plus 10 mm for an upper bent-up face 14', and 20 mm for a lower bent-up face 14'.

The respective constituent sheet members are worked into a product of the heat shielding member of a stacked structure by a process comprising the steps of "putting creases→folding→providing an adhesive →press-bonding→cutting to given sizes" while all are moved in parallel with each other by an apparatus (not shown) made up of a roller group. In FIG. 2(A), reference letter a denotes an adhesive, r a bent-up part, and $r_0$ a folded-back part.

Figure 2B:
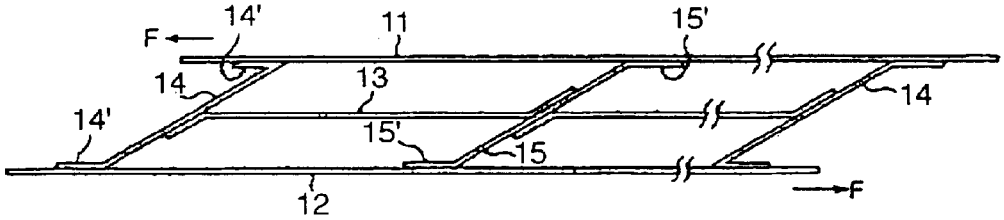

FIG. 2(B) shows a state of the product made up of the respective constituent sheet members, each cut to a given size, in a stacked-up condition, wherein a group of the stand-up pieces 14, and a group of the intermediate stand-up pieces 15 are caused to rise up halfway by pulling one end of the upper sheet 11 in the direction of the arrow F and one end of the lower sheet 12 in the direction of the other arrow F, opposite to the previously described direction, respectively. With the stand-up pieces 14 and the intermediate stand-up pieces 15, standing up so as to be in respective postures shown in FIG. 2(C), there is formed a heat shielding member 1 provided with a space S of an air layer at dual layers, comprising the aluminum foil, that is, the heat reflection foil, provided on the upper face of the upper sheet 11, the intermediate sheets 13, and the lower sheet 12, respectively, and the aluminum foil provided on the outside face of the stand-up piece 14 on the opposite ends of the heat shielding member 1.

Installation of Heat Shielding Member

Figure 1:
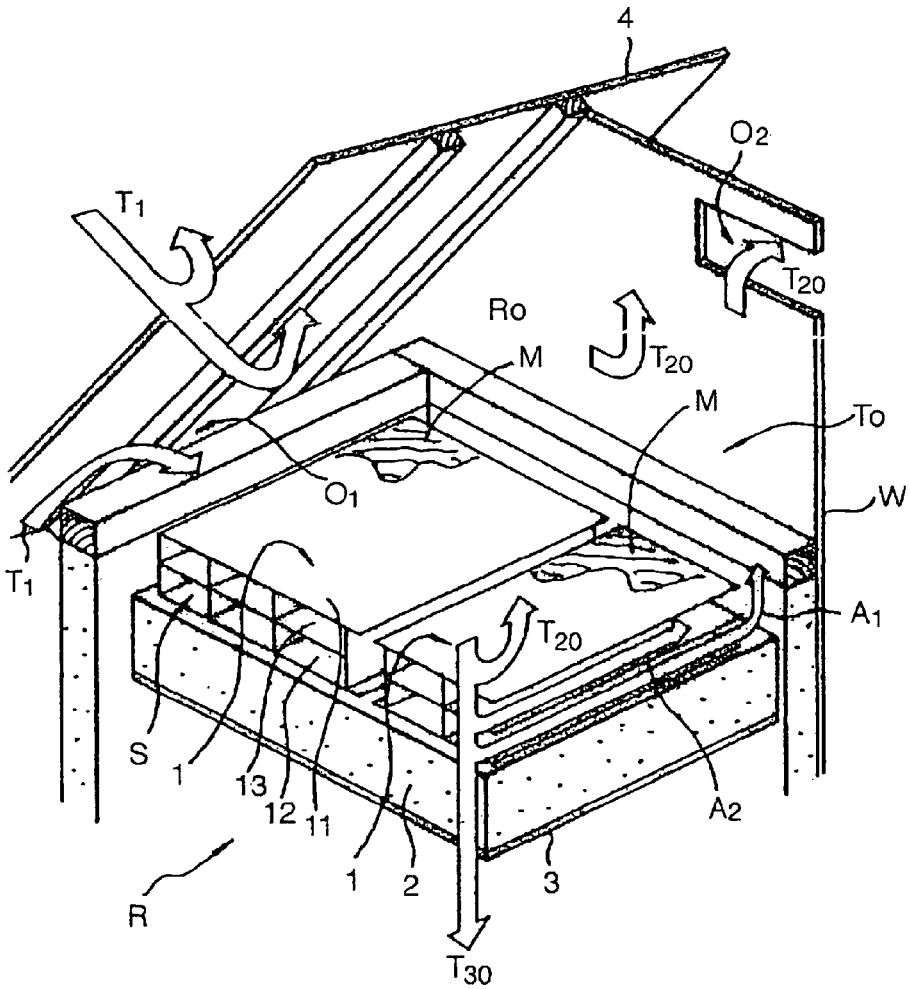
FIG. 1 is a schematic illustration showing operation of the invention.
Figure 2C:
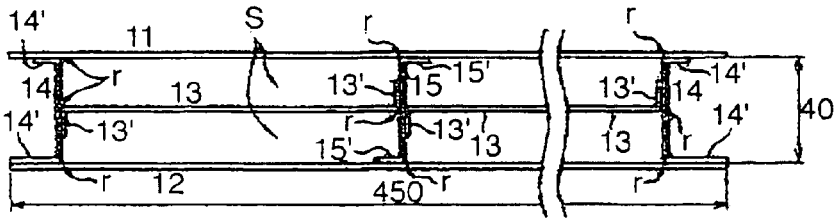
Figure 8:
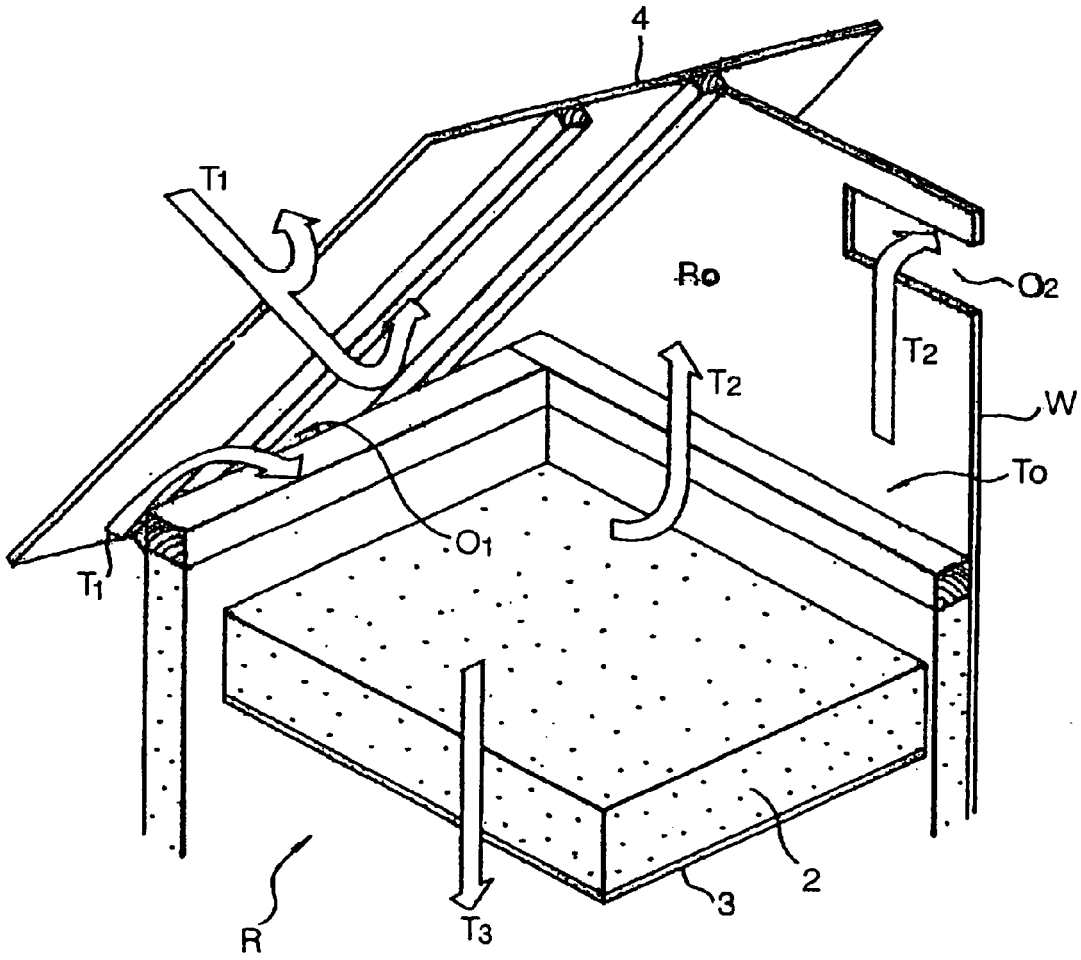
FIG. 8 is a schematic illustration showing operation of a conventional example.

FIG. 1 is a schematic illustration of the heat shielding member according to the invention as applied to the interior of a conventional attic (FIG. 8). In the figure, a rigid urethane foam heat insulator 2 in a board form 200 mm thick is installed on the upper face of the ceiling 3, and the heat shielding members 1, each with the stand-up pieces 14 and the intermediate stand-up pieces 15, standing up as shown in FIG. 2(C), are placed on the upper face of the rigid urethane foam heat insulator 2. The respective heat shielding members 1 are disposed such that the opening at the opposite ends of the respective spaces S of the air layer is not blocked up, the respective heat shielding members 1 can stand on their own and retain their respective shapes by leaning against each other, and parts of the edge of the heat shielding members among a group of the heat shielding members 1, in contact with structures positioned on the periphery or the middle parts thereof, are simply secured to the structures with staples (not shown) or the like, thereby completing the installation of the heat shielding members 1.

Accordingly, since the rigid urethane foam heat insulator 2 is in the board form, and the heat shielding members 1 prior to the installation are in a stacked form, it is easy to store and transport them, so that the installation of a thermal insulation structure for a house can be rationally implemented.

Figure 3A:
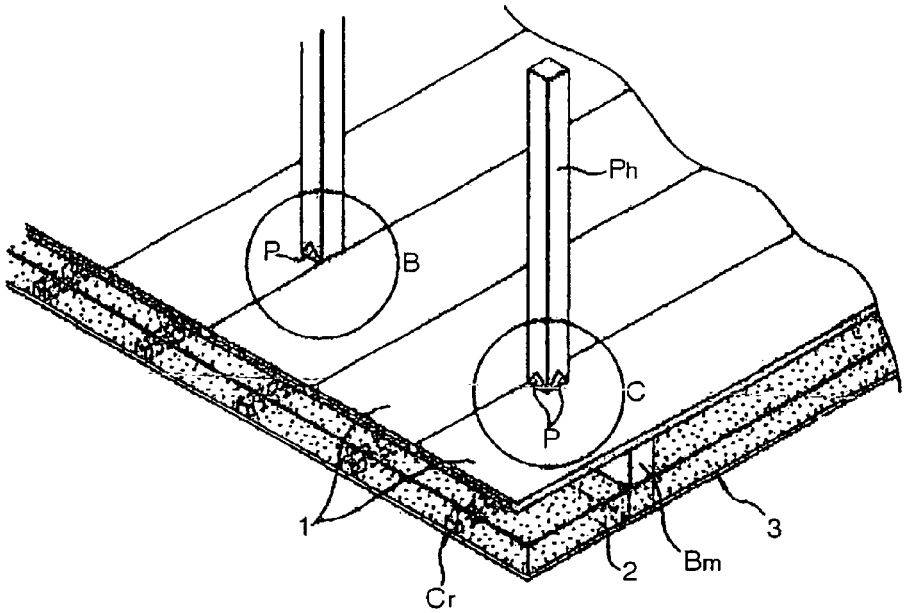
Figure 3B:
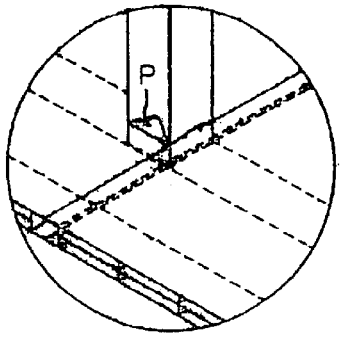
Figure 3C:
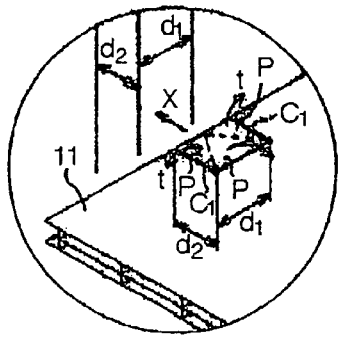

FIG. 3(A) shows an example of the heat shielding member according to the invention as installed on a beam Bm in the ceiling. In the figure, reference letter "Cr" denotes a ceiling joist, the rigid urethane foam heat insulator 2 is installed on the upper face of the ceiling 3, and the respective heat shielding members 1 are laid in parallel on top of the beam Bm. As shown in FIG. 3(C), a portion of $d_1 \times d_2$ in size of the side face of the intermediate sheet 13, and the lower sheet 12, respectively, at a spot where the respective heat shielding members 1 are butted against respective crown posts Ph, respectively, is cut out so as to fit to a size $d_1 \times d_2$ of the respective crown posts Ph while incision lines $C_1$ are cut only in the upper sheet 11, thereby forming three fixture pieces P, which are raised as shown by the respective arrows t, so that the fixture pieces P as raised are butted against three faces of the respective crown posts Ph in a state as fitted to the respective heat shielding members 1, respectively, and are securely attached thereto by staples as shown in FIG. 3(B), respectively (only one piece of the fixture pieces P are shown).

In the thermal insulation structure for the house, thus obtained as shown in FIGS. 1 and 3, because heat rays of attic interior heat $T_0$ undergo specular reflection owing to a smooth surface at the molecular level of an aluminum foil M of the upper sheet 11, a small amount of heat transmitted through the upper sheet 11 similarly undergoes reflection by an aluminum foil M of the intermediate sheets, and moreover, no heat conduction occurs to the aluminum foils M having a thickness in a range of $6\times10^{-3}$ to $6\times10^{-2}$ mm while the air layer of the respective spaces S is also a thermal barrier, heating of the respective heat shielding members 1 themselves can be held down to the minimum, so that heating of the rigid urethane foam heat insulator 2, as applied from the upper face thereof, is mitigated, and thereby heat accumulated in the rigid urethane foam heat insulator 2 can be reduced to about a half as compared with the case where the heat shielding members 1 are not in use (conventional case) in spite of heating of the interior of the attic for long hours during the day.

Fabrication of Heat Shielding Member with Heat Insulator Attached Thereto.

(1) Use of a Rigid Urethane Foam Heat Insulator

Figure 4A:
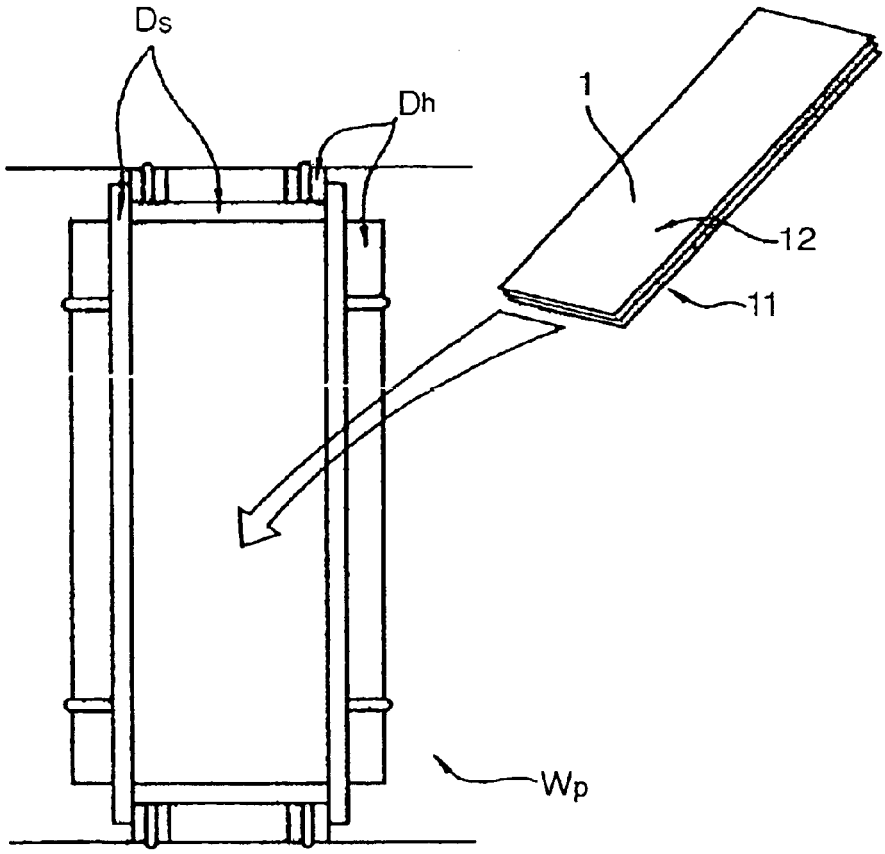
Figure 4B:
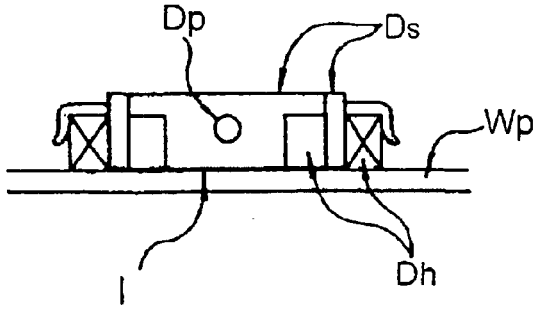

As shown in FIGS. 4(A) and 4(B), a heat shielding member 1, with the stand-up pieces 14 and the intermediate stand-up pieces 15, in as laid-down state of a stacked condition, is placed on a work platform Wp in such a way as to cause the lower sheet 12 to be positioned on the top thereof, a mold is set up by surrounding four side edges of the heat shielding member 1 with a mold release plate Ds, respectively, and securing the mold release plates Ds with respective stress holders Dh to thereby form a cavity in the shape of a board having a desired thickness (200 mm), and a liquid material for rigid urethane foam is injected into the cavity through an injection hole Dp, thereby completing foam molding.

Figure 5:
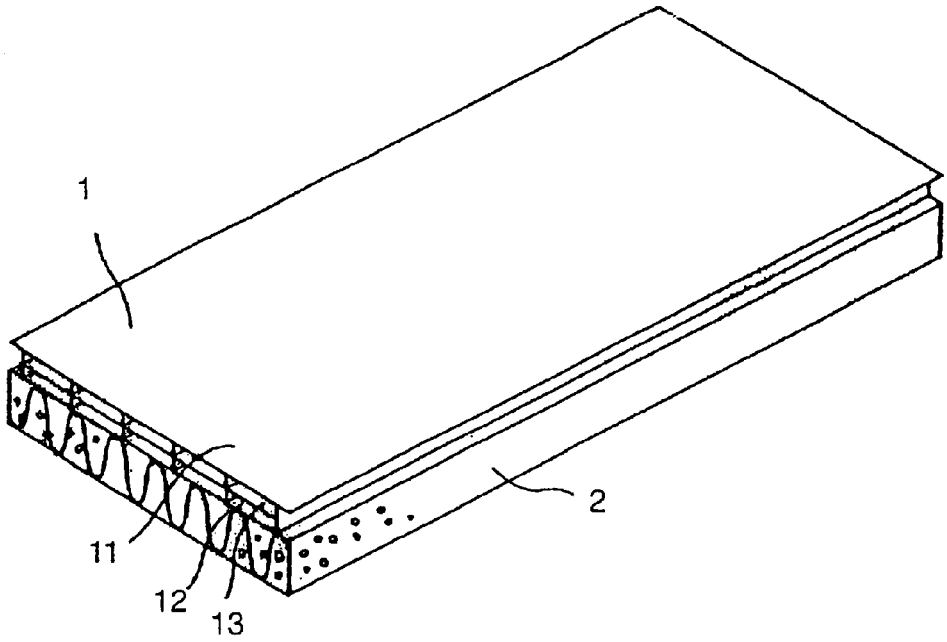
FIG. 5 is a perspective view of the heat shielding member with the heat insulator attached thereto according to the invention.
Figure 6A:
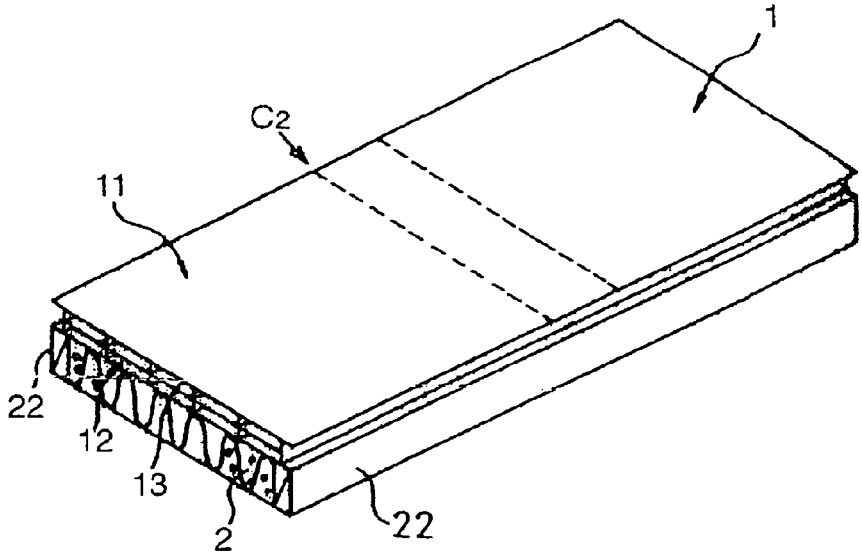
Figure 6B:
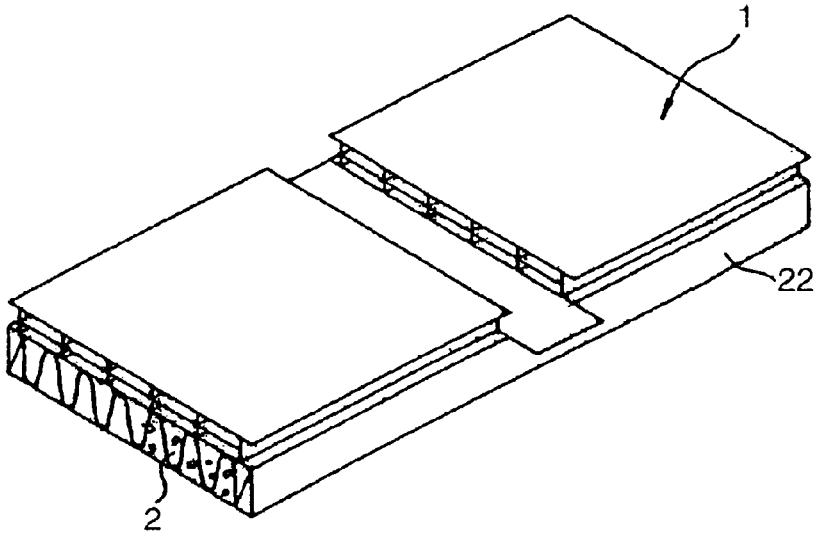

Accordingly, upon removal of the mold release plates Ds, there is obtained a rigid urethane foam heat insulator 2 with the lower sheet 12 of the heat shielding members 1 integrally bonded to the upper face thereof by the agency of bonding strength after solidification as shown in FIG. 5. Further, by executing molding with a splint 22 disposed on both sides of the heat shielding member 1, respectively, at the time of setting up a mold, there can be obtained a rigid urethane foam heat insulator 2 (FIG. 6) with the splint 22 provided on both sides thereof, respectively, and the heat shielding members 1 bonded on the upper face thereof.

(2) Use of a Wooden Board Heat Insulator

A sheet of kraft paper is placed on a mold release plate of a common type cold pressing clamping device (not shown), subsequently, an insulation board 200 mm in thickness with an adhesive applied to both the upper face and underside face thereof is disposed on the sheet of the kraft paper, and the lower sheet 12 of a heat shielding member 1 with the stand-up pieces 14 and the intermediate stand-up pieces 15, in as laid-down state of a stacked condition, is placed on the insulation board, whereupon the kraft paper, the insulation board, and the heat shielding member are clamped. Upon taking out a product obtained by clamping from the cold pressing clamping device after curing of the adhesive, there is obtained a heat shielding member 1 with the insulation board excellent in sound insulating property and heat insulating property, and having a function for absorbing and discharging moisture, bonded to the underside face of the lower sheet 12.

Meanwhile, the reason for sticking the kraft paper on the insulation board is to reinforce low surface strength of the insulation board so as to prevent the insulation board form being damaged by external force.

[Installation of Heat Shielding Member with Heat Insulator Attached Thereto (Not Shown in Figures)]

Because both the rigid urethane foam heat insulator 2 and an insulation board heat insulator 2 have shape-retention property, (a) in the case of installing the heat shielding member between roof rafters, heat insulator retaining metal fittings (not shown) such as a flat plate metal, L-shaped plate metal, and so forth are nailed on the respective roof rafters beforehand, the heat insulator is fitted between the respective roof rafters and placed on the heat insulator retaining metal fittings with the heat shielding member 1 disposed on the roof side (outside), and a valley formed between the heat insulators in the ridge portion of the roof is filled up by on-the-site foaming with a single-liquid type urethane. Subsequently, sheathing roof boards are attached to the roof rafters, and roofing is installed on top of the sheathing roof boards.

(b) in the case of installing the heat shielding member on the sheathing of the ceiling, the heat insulator is directly placed on respective ceiling joists as assembled such that the aluminum foil M of the upper sheet 11 of the heat shielding member 1, used for the purpose of heat reflection, is positioned on the top thereof, gaps formed, for example, on top of the receptacle of the respective ceiling joists, where the heat insulators can not be disposed in continuation, are filled up with glass wool, or the like, and subsequently, a ceiling material is attached to the underside of the respective ceiling joists.

(c) in the case of installing the heat shielding member on the wall face, the heat insulator 2 is fitted between respective pillars and respective studs from outside with the heat shielding member 1 facing outside, the respective heat insulators 2 are held down by nailing splints on the pillars and studs, and subsequently, an exterior finishing material is applied to the outside of the respective heat shielding members 1 while an interior finishing material is applied to the inside of the respective heat insulators 2.

(d) in the case of installing the heat shielding member under the floor, the heat insulator 2 is fitted between respective floor joists while supported by the ground sills and sleepers with the surface of the heat shielding member 1 facing the ground. Thereafter, a portion of the heat shielding member 1, resting on the sleeper {FIG. 6(A)}, is notched and only that portion of the heat shielding member 1 is flattened, thereby enabling the heat shielding member 1 to maintain a three-dimensional shape {FIG, 6(B)}. Subsequently, flooring is installed.

Meanwhile, with the heat insulator 2 provided with the splint 22 integrally bonded to both sides thereof, respectively, either in the case of securing the heat insulator 2 to a building member, for example, the roof rafter, pillar, and so forth, disposed opposite to the side face of the former, by use of the heat insulator retaining metal fittings (not shown), for example, L-shaped plate metal pieces using one piece as a fixture piece, and the other as a holding piece, or flat plate metal fittings using a tip part thereof as a driving piece, and a rear end part as a holding piece, or in the case of fixedly attaching the heat insulator 2 to the building member by nailing down the former with the use of the splints, it is advantageous that the heat shielding member 1 can be firmly retained by use of the splints 22 as fixture members.

As described hereinbefore, with the heat shielding member with the heat insulator attached thereto, since fixture work is executed with the heat insulator having the shape-retention property, installation work in regions such as under the floor, between the roof rafters, and so forth, where it is difficult to carry out such work, can be executed with relative ease. Needless to say, with the respective heat shielding members 1, the edges or the middle parts thereof need to be attached to other structures so as to be able to maintain the three-dimensional shape all the time, however, the heat shielding members 1 keeping the dimensions of the three-dimensional shape need to be fitted without a gap therebetween, and the heat shielding members 1 need to be installed so as not to block up the openings at the opposite ends of the respective spaces S of the air layer as with the case of installing the heat shielding members alone.

Meanwhile, it is to be pointed out that the case where the heat shielding member 1 formed integrally with the heat insulator 2 is installed is equivalent from the viewpoint of a thermal operation effect alone to the case where the heat insulator 2 and the heat shielding member 1 are separately installed such that the latter overlies the former.

Figure 7:
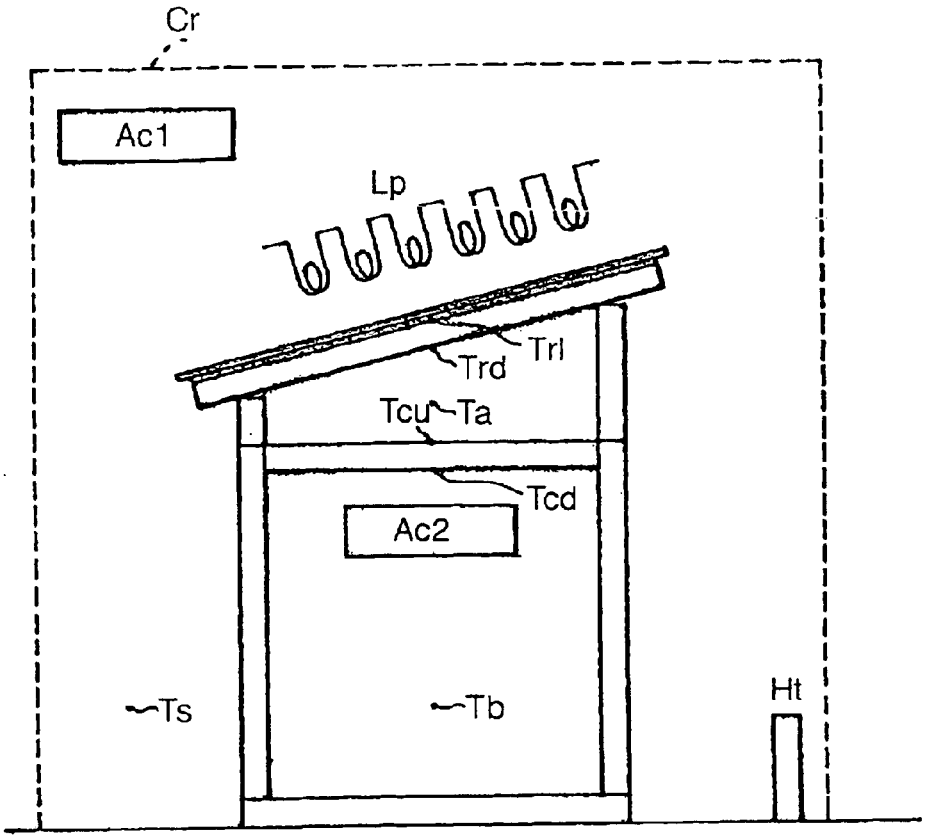
FIG. 7 is a schematic sectional view showing a test apparatus used in development of the invention.

In order to check the effect of a heat shielding member, the inventors took measurements of the heat shielding effect of test models 1 to 5 containing a rigid urethane foam heat insulator of a structure described below, respectively, due to infrared reflection by an aluminum foil bonded to kraft paper of the heat shielding member, and ventilation in the heat shielding member, using a test apparatus shown in FIG. 7, wherein each of the test models is disposed in a sealed space, surrounded by a vinyl sheet cover Cv, and enclosing an air conditioner Ac1 set at 25° C. during tests, a panel heater Ht, and six infrared lamps Lp as a heat source, thereby obtaining measurement results shown in Tables 1 and 2 given below. An air conditioner Ac2, disposed inside the respective models, is kept at 20° C. during the tests.

As for locations where temperature measurement were taken, Tri denotes inside the roof panels, Ta an attic space, Tcd beneath the ceiling panels, Ts the surrounding of the test box, Trd beneath the roof panels, Tcu above the ceiling panels, and Tb a test box.

Test Model 1: The heat insulator is installed in the roof panels. Use is made of the roof panels with the heat shielding member assembled therein. Both ends of the heat shielding member are kept open to allow ventilation.

Test Model 2: The heat insulator is installed in the roof panels. The heat shielding member is not assembled in the roof panels. Both ends of a portion of the roof panels, with the heat shielding member placed in the test model 1, are kept open to allow ventilation.

Test Model 3: The heat insulator is installed in the ceiling panels. Use is made of the roof panels with the heat shielding member assembled therein. The heat insulator is not used in the roof panels, and both ends of the heat shielding member are kept open to allow ventilation.

Test Model 4: The heat insulator is installed in the ceiling panels. The heat shielding member is installed on the ceiling panels with a spacing interposed therebetween. No ventilation is allowed.

Test Model 5: The heat insulator is installed in the ceiling panels. The heat shielding member is not installed.

Summarized results of the tests are shown in Tables 1 and 2. All numerical values given therein represent the average of values obtained from measurement taken five times, respectively.

TABLE 1

| test model | position of rigid urethane foam | position of heat shield member | temperature (°C.) of respective parts of the test models after 5 hrs. from the start of infrared radiation — location of temperature measurements: Tri | Trd | Ta | Tcu | Tcd | Tb | Ts |
|---|---|---|---|---|---|---|---|---|---|
| No. 1 | the roof | inside the roof panel | 36.0 | 23.8 | 23.6 | 23.5 | 22.9 | 23.0 | 24.8 |
| No. 2 | the roof | none | 44.5 | 24.6 | 23.1 | 23.0 | 22.3 | 22.3 | 25.1 |
| No. 3 | the ceiling | inside the roof panel | 35.6 | 28.2 | 26.0 | 25.6 | 21.8 | 22.1 | 25.1 |
| No. 4 | the ceiling | on the ceiling | — | 50.3 | 34.8 | 25.1 | 21.8 | 22.1 | 25.3 |
| No. 5 | the ceiling | none | — | 47.2 | 32.3 | 32.1 | 22.0 | 21.9 | 25.1 |

effect (° C.) and ratio (%) of temperature drop by use of the heat shielding member

TABLE 2 effect (°C.) and ratio (%) of temperature drop by use of the heat shielding member

| test mode 1 | position of heat insulator | position of heat shield. member | location of temp. measurement: Tri | Trd | Tcu | Tri minus Tri for No. 2 model | Trd minus Tcu | effect of heat shield member: temp diff. | ratio diff. |
|---|---|---|---|---|---|---|---|---|---|
| No. 1 | the roof | inside the roof panel | 36.0 | — | — | −8.5 | — | 8.5 | 19% |
| No. 2 | none | none | 44.5 | — | — | — | — | — | — |
| No. 3 | the ceiling | inside the roof panel | 35.6 | — | — | −8.9 | — | 8.9 | 20% |
| No. 4 | the ceiling | on the ceiling panel | — | 50.3 | 25.1 | — | 25.2 | 10.1 | 40% |
| No. 5 | the ceiling | none | — | 47.2 | 32.1 | — | 15.1 | — | — |

SUMMARY OF TEST RESULTS

In the case where the heat shielding member was installed in the roof panels, the temperature inside the roof panels (Tri) was found lower than that for the case where the heat shielding member was not installed therein regardless of whether the rigid urethane foam was installed in the roof panels or in the ceiling panels, indicating that heating was reduced by 19% and 20%, respectively, due to the installation of the heat shielding member under the test conditions. In the case where the heat shielding member was installed on the ceiling panels, the difference between the temperature on the rear surface of the roof (Trd) and the temperature on the surface of the ceiling (Tcu), that is, conduction of heat from the rear surface of the roof to the surface of the ceiling was reduced by 40% due to the installation of the heat shielding member under the test conditions.

Others

The heat shielding member together with the heat insulator can be assembled into a heat insulating roof panel or a heat insulating ceiling panel at a factory before delivery to a construction site. However, it is also possible in some cases to deliver the heat shielding member with the respective spaces S of the air layer, in as-closed state, and to thereby install the same at a spot as required after cutting or notching depending on the condition of the construction site.

It is fairly more advantageous in practice from the viewpoint of mass production and transportability to handle the heat shielding member as a laminated product with the respective spaces S of the air layer, in as-closed state, in the course of a manufacturing process, and transportation.

The heat shielding member 1 bonded with the rigid urethane foam heat insulator 2 may be used in a state as-integrated at the time of molding the heat insulator or in a state as integrated into a heat insulating panel. Besides, both the members may be fabricated and stored, separately, to be bonded together at the construction site at the time of the installation, or may be bonded together at a factory before storage to be subsequently delivered to a warehouse Further, the heat shielding member 1 can be fabricated by manually bonding together kraft paper and an aluminum foil, prepared in advance to a predetermined size, respectively, at a suitable location, as necessary, and in such a case, use can be made of paper made of material difficult to be processed with a roller apparatus, for example, paper of greater rigidity, and plastics.

Still further, for prevention of dew condensation, the upper sheet 11, particularly, the intermediate sheets 13, and the lower sheet 12 may be provided with minuscule holes (pinholes), respectively.

The heat shielding member 1 and the wooden board heat insulator 2 not only in a state as bonded together with an adhesive but also in a state where both the members are in intimate contact with each other, but without being bonded together, can be used as a heat insulating panel for the roof and the ceiling, respectively.

Further, both the members may be fabricated and stored, separately, to be bonded together at the construction site at the time of the installation, or may be installed in a state where both the members are in intimate contact with each other, but without being bonded together.

Also, the heat insulator 2 is preferably formed integrally with the ceiling panel, and particularly, if the heat insulator 2 formed integrally with the heat shielding member 1 is securely attached to the ceiling panel beforehand, this enables a heat insulation work and a ceiling-finishing work including lathwork for hanging wallpaper to be simultaneously completed simply by setting the ceiling panel at a predetermined position, thereby achieving labor-saving and rationalization in housing construction.

INDUSTRIAL APPLICABILITY

As described in the foregoing, with the thermal insulation structure of a house, according to the invention, conduction of heat to the surface of the heat insulators 2 can be significantly reduced, and heating of the heat insulators 2 themselves and heat accumulation therein can be reduced due to reflection of radiant heat by the heat reflection foil on the surface of the heat shielding member installed on top of the respective heat insulators 2, and due to the effect of the airflows $A_1$, $A_2$, passing through the space S between the upper sheet 11 and the intermediate sheets 13, and the space S between the intermediate sheets 13 and the lower sheet 12, respectively, within the heat shielding member 1 as raised, so that an amount of heat penetrating into the living room from the surroundings such as the ceiling, and so forth can be reduced, and energy required for cooling down the living room is thereby significantly reduced. Thus, the thermal insulation structure of the house, according to the invention, is useful for insulating the house from heat.

Further, since the heat shielding member is made up of a plurality of the sheets with the heat reflection foil, such as the aluminum foil, and so forth, bonded to the surface thereof, even if there occurs deterioration in reflection performance of the heat reflection foil on the upper sheet with respect to radiant heat due to adhesion of dust thereto, such deterioration in the reflection performance with respect to radiant heat is compensated for by presence of the heat reflection foil on the intermediate sheets, so that the heat shielding member 1 can exhibit excellent performance over a long term.

Still further, since the spaces of the air layer inside the heat shielding member have the opening, respectively, heat along with moisture creating a cause for dew condensation are discharged by ventilation, thereby preventing internal dew condensation causing impairment of reflection performance and durability. Furthermore, the heat shielding member can be handled in a state of a reduced bulk by laying down the group of the stand-up pieces 14, and the stand-up pieces 15, respectively, at the time of transportation and storage thereof, thus rendering the heat shielding member convenient for transportation and storage. Further, when fabricating the heat shielding member 1, respective constituent materials such as the sheet members and the heat reflection foils can be worked into the product in a rational and mechanized way by the process comprising the steps of "putting creases →folding→providing an adhesive→press-bonding→cutting to given sizes" with the use of the roller device.

Still further, the heat shielding member 1 with the heat insulator 2 bonded thereto can be installed with relative ease even at places where it is difficult to install the heat shielding member 1 alone, and in addition, installation of the heat insulator and installation of the heat shielding member can be simultaneously executed, which is quite convenient from the viewpoint of high efficiency in construction work and a shorter construction time. Further, in the case of the rigid urethane foam heat insulator or the wooden board heat insulator being worked into the heat insulating panel, a step of installing loose fill heat insulators becomes unnecessary, so that a problem of adverse effects of dust on the health of workers engaged in a blowing work can be solved at a stroke.

Still further, in the case of the wooden board heat insulator 2 being used, even if the same is installed on inclined surfaces such as the roof, there is no fear of the wooden board heat insulator 2 sliding down or losing thickness over time as with the case of the fibrous heat insulator for blowing, and if installed on the rear face of the roof, the sound of rain can be shut out due to the sound insulating property of the wooden board heat insulator 2. In addition, because the primary constituent materials of the wooden board heat insulator 2 are building scrap lumbers, sawmill waste, barks, and so forth, which are reproducible natural resources and utilized refuse materials, and a boron compound for prevention of combustion and serving as a preservative for wood, the wooden board heat insulator 2 is superior in that it is environmentally friendly, and it can be produced at room temperature, eliminating the need for use of much energy.

What is claimed is:

1. A heat shielding member comprising a plurality of sheets including a least an upper sheet, a lower sheet, and a heat reflection foil laminated to an upper face of at least the upper sheet, and a group of stand-up pieces forming respective spaces of an air layer between the respective sheets, with said stand-up pieces being securely attached to at least the upper sheet and the lower sheet at bent up faces provided at the opposite ends thereof, and being freely bendable at bent-up parts, thereby forming a structure wherein the respective sheets are capable of being pressed in contact with each other, and stacked by laying down the group of the stand-up pieces.

2. The heat shielding member according to claim 1, wherein an upper faces of the lower sheet is provided with a heat reflection foil.

3. The heat shielding member according to claim 1, wherein the intermediate sheets is securely attached to the ends of the stand-up pieces at the bent-up faces of the bendable bent-up parts.

4. The heat shielding member according to claim 1, wherein the underside face of the lower sheet is adapted to be fixedly attached to an upper face of a heat insulator.

5. The heat shielding member according to claim 1, wherein the underside face of the lower sheet is fixedly attached to a rigid urethane foam heat insulator by solidification bonding due to foam molding.

6. The heat shielding member according to claim 4, wherein the heat insulator comprises a wooden board heat insulator.

7. A thermal insulation structure for use on an inner face of a roof and for use on outside faces of partition sheet members including ceilings and walls of a house, the insulation structure comprising:

a heat insulator in a board form having an inner face for orientation toward a house interior to be insulated and an outer face for orientation away from the house interior; and a heat shielding member disposed on the outer face of said heat insulator, said heat shielding member comprising:

a plurality of sheets having upper faces an lower faces, the sheets being spaced to provide ventilation openings for air layers therebetween;

a group of stand-up pieces positioned between respective adjacent ones of said sheets, the stand-up pieces having a first face at a first bendable end thereof secured to the lower face of a top one of said sheets and a second face at an opposing second bendable end thereof secured to the upper face of an adjacent one of said sheets; and heat reflection foils, one said heat reflection foils being secured to the upper face of the top one of said sheets and another said heat reflection foil being secured to the upper face of the adjacent one of said sheets, wherein the heat shielding member secured to the heat insulator mitigates heat accumulation by the respective heat insulator.

8. The thermal insulation structure according to claim 7, wherein the heat insulator comprises a wooden heat insulation board, and the respective sheets of the heat shielding member comprise paper.

9. The thermal insulation structure according to claim 7, wherein a lower face of a bottom one of said sheets of the heat shielding member is fixedly attached to the heat insulator.

10. A heat shielding member comprising:

a plurality of sheets including at least an upper sheet and an adjacent sheet;

a heat reflection foil laminated to an upper face of at least the upper sheet; and a group of stand-up pieces having bendable parts, a first end of said stand-up pieces being secured to a lower face of the upper sheet and a second opposing end of said stand-up pieces being secured to an upper face of the adjacent sheet for forming respective spaces for an air layer between the respective said sheets, wherein the respective sheets are capable of being pressed in contact with each other and stacked by laying down the group of the stand-up pieces.

11. The heat shielding member of claim 10, wherein when said sheets are stacked, one end of the top sheet extends outwardly from the adjacent one of said sheet and when said stand-up pieces are folded up, said sheets are vertically aligned.

* * * * *